United States Patent [19]

Matsuyama et al.

[11] 4,046,187

[45] Sept. 6, 1977

[54] PROCESS OF MANUFACTURING KILLED STEEL INGOTS OF SUPERIOR QUALITY

[75] Inventors: Shigeru Matsuyama, Utsunomiya; Hiroshi Mikami, Imaichi, both of Japan

[73] Assignee: Aikoh Co., Ltd., Tokyo, Japan

[21] Appl. No.: 587,104

[22] Filed: June 16, 1975

[30] Foreign Application Priority Data

June 24, 1974 Japan ..... 49-71428

[51] Int. Cl.[2] ..... B28B 7/36

[52] U.S. Cl. ..... 164/53; 106/38.22; 106/38.23; 106/38.28; 164/123; 249/197; 249/202

[58] Field of Search ..... 106/38.2, 38.22, 38.5, 106/38.23, 38.27, 38.28; 164/123, 41, 43, 53; 249/197, 199, 200, 201; 252/62

[56] References Cited

U.S. PATENT DOCUMENTS

| | | | |
|---|---|---|---|
| 2,513,602 | 7/1950 | Udy | 164/53 |
| 2,821,758 | 2/1958 | Vallak | 106/38.5 R |
| 3,344,838 | 10/1967 | Nouveau | 249/200 |
| 3,612,155 | 10/1971 | Matsuyama et al. | 164/53 |
| 3,713,852 | 1/1973 | Wiley | 106/38.5 R |
| 3,848,655 | 11/1974 | Sato et al. | 164/43 |
| 3,923,526 | 12/1975 | Takashima | 106/38.27 |

*Primary Examiner*—Lorenzo B. Hayes
*Attorney, Agent, or Firm*—Fay & Sharpe

[57] ABSTRACT

A process of manufacturing killed steel ingots of superior quality by forming the sound hot top portion and reducing the concentration of nonmetallic inclusion in the mushy zone of ingot bottom, characterized by arranging on the molten steel surface immediately after the pouring of the molten steel into a mold, a board-like molded heat-retaining material in which lining of a layer consisting of easily-flammable material is made to an exothermic, diabatic layer consisting of crushed flat charcoal, a refractory material expansible by heating and a binder.

2 Claims, No Drawings

PROCESS OF MANUFACTURING KILLED STEEL INGOTS OF SUPERIOR QUALITY

This invention relates to an improvement in a process for carrying out at one operation to form a sound hot top portion and reduce a concentration of nonmetallic inclusion in a mushy zone of steel ingot bottom from molten steel after pouring into a mold.

In manufacturing killed steel ingot, hot top portion will be exposed to the air and the top surface thereof will be cooled earlier when the molten steel poured into a mold solidifies, so that if the hot top portion were left as it is it will solidify earlier than the body of the steel ingot to produce piping and deteriorate the steel ingot. Accordingly it has conventionally been carried out to avoid an occurrence of such piping by using a heat-retaining material for hot top portion to heat retain the hot top portion and delay solidification.

It is known that with heat-retaining for the sole purpose of making the hot top portion sound, there occurs a flow dropping of crystal according to the occurrence and growth of nuclei of the crystal in solidification taken place at the hot top portion (the upper end of steel ingot) so that the flow includes a part of dentrite on the way and accompanys the non-metallic inclusion in the steel concurrently to convey them to the ingot bottom; as a result thereof at the ingot bottom there takes place a co-existing zone of iron crystal and molten steel to increase viscosity and the inclusion may become incapable of floating up to make a mushy zone having much inclusion at the bottom and to make a polluted portion there. Therefore, it was proposed already to heat the top surface by using powder of heating and heat-retaining property, which has calorific volume more than required for heat-retaining the hot top, and to delay the formation of the nuclei of crystal, which are produced in the neighbourhood of the mold top portion, so as to proceed with a solidification starting at the ingot bottom.

According to conventional process, however, since the heat-retaining agent which is sprinkled on the top surface of said ingot is powder, the thickness of the sprinkled heat-retaining layer is indefinite and even if a suitable thickness necessary for the heat-retaining were predetermined, it may be difficult to make the thickness suitable in practicing. Accordingly there is such a disadvantage that in expectation of a safety the powder must be used in extra amount and provided with rapid-burning property. With other top surface board-like heat-retaining material as additive material a definite heat-insulating property is obtainable, but in the case of exothermic composition binding agent is mixed, and therefore the burning velocity will be lowered rather than in the case of powdery heat-retaining agent. To compensate for the lowering of the burning velocity a great amount of burning promotor is required compared with the case of using powdery heat-retaining agent thereby raising the temperature caused by the burning of said promotor and lowering the heat-insulating property. Accordingly in the case of large size steel ingot two layers of exothermic layer and heat-insulating layer may be necessary, particularly in the case of avoiding the formation of mushy crystal, it may be required to increase the calorific volume generating, so that it is necessary to thicken the exothermic layer and then inevitably the heat-insulating layer in proportion thereto so as not to escape heat thereby providing very thick heat-retaining board so far as conventional materials are used and working and economic demerits.

According to the present invention, it is possible to make heat-retaining of hot top and reduce the concentrating nonmetallic inclusion in the mushy zone at the bottom only by improving the composition constituting the heat-retaining moulded board-like material which serves both for exothermic and heat-insulating properties, is of high performance and is arranged on hot top surface, and by placing said heat-retaining material on the hot top surface. That is, the heat-retaining board-like material employed in the present process uses, as basic exothermic component, flat, crushed charcoal in the range 1–10 mm. Charcoal has a great number of voids finer than in the structure of wood, and when crushed it becomes flat with the fine voids as they are. When used for moulding, therefore, almost all the thin pieces laterally pile up to form elaborate lamination layer. When it floats on the top surface of molten steel it heavily burns at the contact surface with the molten steel because of large surface area through porosity of each charcoal piece. Most of the heated air advances toward the molten steel surface to pass through the layers of the heat-retaining board, only a small amount of the air escaping, high temperature burning zone is limited to the neighbourhood of hot top surface, and the temperature of the burning zone hardly rises, whereby causing exothermic reaction at the hot top surface and heat-insulating reaction at the upper portion. To the contrary, in case crushed charcoal is used without moulding it is difficult to become lamination layer so that the effect will be reduced sharply. Further, charcoal itself, being light, becomes heat insulating property having the best density for the first time after an elaborate moulding of the crushed goods; therefore charcoal may retain sufficient calorific volume even in its thin state compared with other materials so that it is not required to separately heat it for avoiding formation of mushy zone, besides the hot top heat-retaining purpose, thereby providing an improved working property. Other carbon materials such as coke, graphite and anthracite are inferior to charcoal in porosity, density, burning rate and diabatic property of moulding. It may be hard to give both the exothermic property and the diabatic property to the other materials and they will be no more than a partial substitute for charcoal as refractory material.

The following is the reason why in the board-like moulding heat-retaining material employed in the present process the composition range of each component is defined.

Charcoal content requires more than 30% to exert an exothermic effect, and with less than 30% content burning power being small, it will be incapable of obtaining an exothermic effect even in great burning power of heat-retaining board as in the case of large size steel ingot. Further, it exceeds 77% it will be impossible to suffice the required amounts of other components. If less than 1 mm in particle size charcoal does not become flat and it may not moulded in lamination layer. When charcoal or more than 10 mm in particle size, the moulding heat-retaining material may have greater voids so as to lower the heat-retaining property.

Moreover, in this invention there are added less than 20–50% of refractories expansible when subjected to heat, such as acid treated graphite, vermiculite, pearlite and obsidian to expand the heat-retaining board when using, fill the exposing portion of the hot top surface, which is made between the heat-retaining board and the mold wall, and then compensate for the contraction of said heat-retaining board, which is caused by the burning of charcoal. Mixing of more than 50% refractory will lose the burning property and that of less than 20% will be insufficient for expansion. In case high hot strength of heat-retaining board is required, part of the refractory expansible when subjected to heat shall be substituted by non-expansible refractory. As the non-expansible refractory there may be used any of acid refractories such as siliceous sand, quartz sand, silica powder, diatomaceous earth, shale, pearlite and; neutral refractories such as graphite, coke, alumina, kaolin and chamotte; and basic refractories such as dolomite, magnesite, calcined dolomite, magnesia, olivin sand and forsterite. In moulding heat-retaining board a binding agent is used. Both the organic and inorganic binders are employed but preferably organic binder is used irrespective of the size of moulding. As organic binder there may be employed resins, starches and glues. In addition it is possible to concentrate the expansion reaction to the environment not only by mixing uniformly the material which is expansible when subjected to heat but also by maldistributing it to the peripheral portion in emphasis.

Furthermore, the heat-retaining board used in the present process may be used in less amount of hot melt as in small size steel ingot, and therefore, in less retaining calorific volume so that the hot top surface is likely to be cooled when adding the heat-retaining board. Accordingly the ignition to said heat-retaining board is likely to delay. To accelerate ignition of heat-retaining board there may be provided an igniting layer so as to be able to make immediate ignition when the heat-retaining board has contacted the molten steel and to effect a heating of the molten steel surface. If ignition of the heat-retaining board delayed there may be a fear of forming solidified material because of the cooling of the molten steel top surface even if for a short time, and in case the solidified material descends it accelerates formation mushy crystal thereby causing a reverse effect. Since it is impossible to melt the descended solidified material even if heating is carried out after a formation of the solidified material, said ignition layer must be provided to avoid the solidification.

As an exothermic source there is used easily-oxidizable metal such as aluminium, silicon or magnesium as a material which does not generate gas and which is quickly ignitable because the object of exothermic composition for accelerating ignition lies in rapid burning. Any is selectable from among oxygen-generating materials such as iron oxide, manganese oxide, alkali nitrate, alkali chlorate and alkali perchlorate and among acid, neutral and basic refractories as filling material; and it is possible suitably to select either pulverulent body or fibrous body. Moreover, burning at uniform rate shall be effected by adding a fluoride such as silica, soda fluoride or cryolite as burning modifier. In addition there may sometimes be added bulking agent such as organic fiber, wood powder, saw dust, chips, waste paper, pulp and coal powder to provide porosity. The binding agent used in moulding said exothermic composition in thin layer can be resins, water glass, cements, clays or the like. In view that the object of said exothermic composition layer is to ignite quickly, the mixing quantity of the easily-oxidizable metal is made 10–30% and the particle size to effect sufficient ignition burning must be fine powder of less than 0.5 mm to enlarge the surface area. With less than 10% of said metal it will be incapable of obtaining a sufficient burning state for ignition, and with more than 30% there will be no change of effect so as to be unsuitable.

With respect to the thickness of the layer of said exothermic composition, it may sometimes be thin to such an extent that a layer is merely made to the board surface of said board-like moulding but it may comparatively be thick in the mouldings having low charcoal mixing ratio to increase ignition power. If less than 5 mm, however, ignition power to charcoal will be lowered.

In the board-like heat-retaining material employed in the present process it is required to secure exothermic quickness and the absolute quantity of calorific volume because the material must be provided with a heating effect. The exothermic quickness is that the time until the reach to the maximum temperature in burning after having touched the hot melt is maintained within 4 minutes. In order that ignition may occur immediately after contact of said board-like moulding to the hot melt so that the molten steel may not have a cooling time to prevent said solidified material from formation, it is required to give quickly calorific volume sufficient not to produce flow descent on the way of steel ingot solidifying to the neighbourhood of upper portion of the molten steel (the neighbourhood of the head portion of steel ingot, mainly in hot top portion), heating the molten steel without cooling in any way. There is a fear of producing solidified material if the burning does not reach maximum within 4 minutes. Further, more than 2 kg of heat-retaining board must be used per ton of molten steel so as not to generate flow descent in the hot top portion before the molten steel finishes solidification.

The reason therefor is that absolute quantity of calorific volume of the heat-retaining board to avoid the formation of mushy crystal requires 4,000 Kcal at the lowest per ton of molten steel, but in the case of heat-retaining board where 30% charcoal was mixed, 2 Kg in use amount of the board almost corresponds to said calorific volume required. In view that 2 Kg in use of the heat-retaining board per ton of molten steel are the minimum quantity of thermit heat-retaining agent for hot top, it means that 2 Kg are a quantity required for heat-retaining of hot top and that with this quantity it is possible to avoid formation of mushy crystal, too.

The board-like moulding used in the process of this invention is manufactured in such manner that said mixing components are first mixed to be made slurry with addition of water, said slurry is poured into a moulding frame, the water content is separated by filtration from the slurry by pressure reduction method or other method, an exothermic composition slurry prepared in the same way is placed on said first layer to make composite layers, and finally the moulding of said composite layers is removed from said frame so as to be heated, dried and hardened.

The invention will be further described with reference to the following example.

| (1) Composition of charcoal-containing layer | Mixing I | Mixing II |
|---|---|---|
| Crushed charcoal | 60% by weight | 30% by weight |
| Vermiculite ore powder | 20% | 50% |
| Coke powder | 17% | — |
| Phenol resin | 3% | 20% |
| (2) Ignition layer | Mixing I | Mixing II |
| Aluminium powder | 10% by weight | 20% by weight |
| Magnesium powder | — | 10% |

-continued

| | | |
|---|---|---|
| Ferric oxide | 20% | 50% |
| Potassium nitrate | 8% | 5% |
| Residual ash of aluminium | 47% | 5% |
| Sodium fluoride | 3% | 4% |
| Pulp | 5% | 2% |
| Phenol resin | 7% | 4% |

(3) Constitution of board-like moulding:
Charcoal mixing
(i) Lining of 40 mm thickness of composition layer in Mixing II and 5 mm thickness of ignition layer in Mixing I
(ii) Lining of 30 mm thickness of charcoal mixing composition layer in Mixing I and 5 mm thickness of ignition layer in Mixing II (4) Heat-retaining agent in comparative example:
Aluminium type thermit hot top heat-retaining powder of 1,500 Kcal/Kg exothermic volume.

The board-like moulding of the constitution (3) above was thrown for use onto three 18T steel ingot immediately after pouring, carrying out concurrentlya comparative test for comparative heat-retaining agent under the same conditions. In all the three ingots the hot top portion was flat, no piping was formed and no defect was found in the hot top portion. At each of seven places of 6%, 10%, 14%, 18%, 22%, 26% and 30% from the bottom of each ingot, which places corresponding to a mushy zone, a piece of steel was cut away from central portion. Each steel piece thus cut was rolled to 100 mmϕ to prepare test piece. A microscopic observation (of 400 magnifications) was made to the surface of each test piece to calculate the number of nonmetallic inclusion in a certain definite area. The following table is a comparison of purification degree of each test piece thus calculated in its nonmetallic inclusion.

| Ingot size | Test No. | Kind of hot top heat-retaining agent and weight in use | The number of nonmetallic inclusion — Height (%) from ingot bottom 6 | 10 | 14 | 18 | 22 | 26 | 30 |
|---|---|---|---|---|---|---|---|---|---|
| 18t | (i) | This invention 40Kg | 22 | 22 | 20 | 16 | 13 | 12 | 13 |
| | (ii) | This invention 40Kg | 23 | 20 | 18 | 18 | 16 | 13 | 16 |
| 10t | (i) | Comparative example 45Kg | 53 | 70 | 92 | 71 | 49 | 40 | 34 |
| | (ii) | Comparative Example 45Kg | 60 | 90 | 114 | 73 | 66 | 49 | 42 |

It will be clear from the above table that in the process of this invention the nonmetallic inclusion in mushy zone can be reduced by ½ - ⅓ compared with conventional process.

What is claimed is:

1. In the process of manufacturing killed steel ingots by solidifying molten steel in a mold while covering the upper surface of said molten metal with a hot topping material, wherein the improvement comprises:

arranging on the upper surface of the molten steel immediately after pouring it into a mold in excess of 2 kg. per ton of molten steel of a board-like, heat-retaining material having (a) a layer of easily-flammable material consisting of a mixure of oxidizable metal, selected from the group consisting of aluminum, silicon and magnesium and mixtures thereof; an oxygen supplying agent selected from the group consisting of iron oxide, manganese oxide, alkali metal nitrate, and mixtures thereof; a burning modifier selected from the group consisting of, sodium fluoride, cryolite and mixtures thereof; and a binder and (b) a molded laminated layer of heat-insulating material consisting of (i) 30 to 77 percent by weight of charcoal particles having a particle size of from 1 to 10 mm, (ii) 20 to 50 percent by weight of a heat expansible refractory material selected from the group consisting of graphite, vermiculite, obsidian, perlite and mixtures thereof, and (iii) a binder, whereby the concentration of nonmetallic inclusions in the bottom of the ingot formed are reduced.

2. The process of claim 1 wherein said board-like, heat-resistant material is used in an amount sufficient to cause its temperature to reach more than 1,600° C. within 4 minutes of contacting said molten metal.

* * * * *